US005090148A

United States Patent [19]

Brooks

[11] Patent Number: 5,090,148

[45] Date of Patent: Feb. 25, 1992

[54] FIREARM SAFETY MECHANISM

[75] Inventor: Frank Brooks, Jupiter, Fla.

[73] Assignee: Saf T. Lok. Corporation, West Palm Beach, Fla.

[21] Appl. No.: 556,016

[22] Filed: Jul. 20, 1990

Related U.S. Application Data

[63] Continuation-in-part of Ser. No. 202,988, Jun. 6, 1988, Pat. No. 4,987,693.

[51] Int. Cl.[5] ..... F41A 17/04

[52] U.S. Cl. ..... 42/70.11

[58] Field of Search ..... 42/70.11, 70.01, 70.04, 42/70.05, 70.06

[56] References Cited

U.S. PATENT DOCUMENTS

| | | | |
|---|---|---|---|
| 2,803,910 | 8/1957 | Lyle | 42/66 |
| 3,199,240 | 8/1965 | Largen | 42/70.03 |
| 3,368,297 | 2/1968 | Lentz | 42/70.11 |
| 3,720,014 | 3/1973 | Goodrich | 42/70.11 |
| 3,735,519 | 5/1973 | Fox | 42/70.05 |
| 3,768,189 | 10/1973 | Goodrich | 42/70.11 |
| 3,939,679 | 2/1976 | Barker et al. | 42/70.11 |
| 4,003,152 | 1/1977 | Barker et al. | 42/70.11 |
| 4,014,123 | 3/1977 | Williams | 42/70.11 |
| 4,084,341 | 4/1978 | Cervantes | 42/70.11 |
| 4,291,481 | 9/1981 | Hillberg | 42/70.02 |
| 4,302,898 | 12/1981 | La Rue | 42/70.11 |
| 4,457,091 | 7/1984 | Wallerstein | 42/70.11 |
| 4,488,370 | 12/1984 | Lemelson | 42/70.11 |
| 4,499,681 | 2/1985 | Bako et al. | 42/70.07 |
| 4,682,435 | 7/1987 | Heltzel | 42/70.11 |
| 4,763,431 | 8/1988 | Allan et al. | 42/70.11 |
| 4,987,693 | 1/1991 | Brooks | 42/70.11 |

*Primary Examiner*—Michael J. Carone

*Attorney, Agent, or Firm*—Eckert, Seamans, Cherin & Mellott

[57] ABSTRACT

A firearm safety mechanism includes a lock with engagement structure. The engagement structure has a locked position in which the engagement structure operatively engages a portion of the firing mechanism to prevent discharge of the firearm. The engagement structure also has an unlocked position permitting operation of the firing mechanism. The lock includes at least one push button adapted to disengage the lock and permit movement of the engagement structure from the locked position to the unlocked position upon the reception of a predetermined selection criteria. Method and apparatus for attaching this and other safety locks to firearms, particularly revolvers, is also disclosed. The firearm can be locked against unauthorized use and unlocked by an authorized user without resort to exterior accessories.

12 Claims, 8 Drawing Sheets

FIREARM SAFETY MECHANISM

CROSS-REFERENCE TO RELATED APPLICATIONS

This application is a continuation-in-part of Applicant's co-pending U.S. patent application, Ser. No. 202,988, now U.S. Pat. No. 4,987,693 entitled "FIREARM SAFETY MECHANISM" and filed June 6, 1988.

BACKGROUND OF THE INVENTION

1. Field of the Invention

This invention relates generally to firearms, and more particularly to firearm safety mechanisms.

2. Description of the Prior Art

There is continuing concern about the prevalence of hand guns and other firearms. One of the objections to firearms relates to the use of these weapons by unauthorized persons. Tragic accidents occur when children happen upon weapons, often in their own homes, and attempt to play with them. The safety mechanisms that are found on firearms are not adequate to prevent injury, and curious children will often move the safety to the "off" position without their knowledge. Most revolvers do not have a safety. A measure of safety can be obtained by removing the bullets from the weapon, but it is time consuming to load a weapon in an emergency situation and the danger exists that the gun will not be loaded when it is needed immediately.

Another alarming situation is encountered when unauthorized persons wrestle weapons from police officers or private citizens and turn them on the owner or others. The safety is only a slight impediment to firing the weapon, and at best gives the police officer or owner only an instant to retrieve the weapon.

A number of locking mechanisms have been devised to retard the unauthorized use firearms. Locks have been created which attach to the trigger area of a firearm to prevent access to the trigger, and thus to render the weapon inoperable. Representative patents include Bako, et al. U.S. Pat. No. 4,499,681, and Cervantes, U.S. Pat. No. 4,084,341. These locks are cumbersome and difficult to remove from the weapon, even by the authorized user. This can reduce the effectiveness of the weapon in emergency situations. The police officer in immediate need of the weapon, or the private citizen who must use the weapon for self defense, cannot tolerate significant delays is rendering the weapon operable. External locks must also be carried when not attached to the weapon in order to keep the lock at hand. Other mechanical locks require keys which can be easily lost or misplaced and are difficult to manipulate in the dark.

Most mechanical locks are difficult or impossible to open without looking at the lock. These locks present problems at night, during emergency situations when the eyes cannot be taken from another person or object, or when the user might not have on glasses necessary for close-in vision.

Electronic locks for firearms have also been devised. These mechanisms render the firearm operable or inoperable upon the reception of a suitable signal that is produced by a remote signal-generating unit carried by the authorized user. Examples of such devices are found in Heltzel, U.S. Pat. No. 4,682,435, and Lemelson, U.S. Pat. No. 4,488,370. These devices are not desirable insofar as the signal-generating device can be lost or misplaced by the authorized user, after which the locking mechanism will be inoperable. Also, dead batteries can render these devices useless.

Still another type of lock for a firearm is intended to prevent the accidental discharge of the weapon which sometimes occurs when the gun is dropped or jarred. Such a lock is disclosed by Largen, U.S. Pat. No. 3,199,240. These mechanisms typically involve a pressure-activated release that is provided in a portion of the firearm that is in contact with the user when the weapon is held in the firing position, such as in the butt of a gun stock or the hand grip of a handgun. The safety is deactivated when the release is moved by the placement of the gun stock against the shoulder or by grasping the hand grip. Should the weapon be dropped, relaxation of pressure on the release will automatically lock the weapon against accidental discharge. These locking mechanisms are effective only to prevent firing of the weapon when the gun is not positioned properly, and thus do not discriminate between authorized and unauthorized users.

Yet another typed of lock for a firearm is a combination lock which is intended to be built integrally with the firearm. Examples of such locks include Allan et al,, U.S. Pat. No.4,763,431, LaRue, U.S. Pat. No. 4,302,898, Fox, U.S. Pat. No. 3,735,519, Williams U.S. Pat. No. 4,014,123, and Wallerstein, U.S. Pat. No. 4,457,091. These locks are bulky, and typically require very significant installation efforts.

It would be desirable to provide a firearm safety lock which can lock a firearm against unauthorized use, yet can be readily activated by an authorized user. It would further be desirable if the locking mechanism would prevent accidental discharge of the weapon when it is dropped or jarred. It would also be desirable if the locking mechanism would require no external accessories, such that the authorized user could readily activate, or deactivate, the weapon at any time. It would also be desirable to provide a firearm safety lock which can be activated or deactivated without viewing the lock. It further would be desirable to provide a firearm safety lock which is not bulky, and which would not hamper operation of the firearm or the lock when installed. It also would be desirable to provide a firearm safety lock which is relatively easy to install and does not require significant modifications to existing gun structures.

SUMMARY OF THE INVENTION

It is an object of the invention to provide a firearm safety mechanism which will render the weapon inoperable to unauthorized users.

It is another object of the invention to provide a firearm safety mechanism which will prevent firing of the weapon when it is accidentally dropped or jarred.

It is ye another object of the invention to provide a firearm safety mechanism which can be quickly activated or deactivated by an authorized user.

It is still another object of the invention to provide a firearm safety mechanism which will not require external accessories.

It is yet another object of the invention to provide a firearm safety mechanism which can be activated or deactivated without viewing the mechanism.

It is another object of the invention to provide a firearm safety mechanism which is easily installed.

It is still another object of the invention to provide a firearm safety mechanism which is easily manipulated to lock and unlock the firearm.

These and other objects are provided by a firearm safety mechanism having an engagement portion moveable between a locked position in which the engagement portion operatively engages a moveable portion of the firing mechanism to prevent discharge of the firearm, and an unlocked position permitting operation of the firearm. A moveable lock member is operatively connected to the engagement portion, and has at least one protrusion. At least one rotatable ratchet wheel has a plurality of ratchet teeth and at least one channel adapted to receive the protrusion when the ratchet wheel is rotated sufficiently to align the channel with the protrusion. A pushbutton for each ratchet wheel is adapted for movement substantially parallel to the axis of rotation of the ratchet wheel. At least one ratchet actuator is positioned substantially adjacent to the ratchet teeth of the ratchet wheel and is adapted for substantially axial and tangential movement relative to the ratchet wheel when the pushbutton is depressed so as to engage the ratchet teeth and rotate the ratchet wheel. Depression of the pushbutton a predetermined number of time will rotate the ratchet wheel so as to align the channel with the respective protrusion, the alignment permitting insertion of the protrusion into the channel and thereby movement of the engagement portion from the locked position to the unlocked position.

The firearm safety mechanism according to the invention can be installed so as to be substantially entirely external to the firearm. The lock and engagement portion can be positioned such that the engagement portion will cooperate with an existing external safety mechanism on the weapon, as described more completely in Applicant's co-pending U.S. patent application Ser. No. 202,988, filed June 6, 1988, and now U.S. Pat. No. 4,987,693. The firearm safety lock of the invention can also be adapted for use with the external safety of many types of weapons, including safeties existing on rifles and shotguns.

Revolvers typically do not have external safety mechanisms suitable for use with an external lock. The invention can be adapted for revolvers by the provision of a pin mechanism. A suitable opening is formed in the frame of the firearm. The pin is slidable through the opening to a position where the pin operatively engages a portion of the firing mechanism of the firearm so as to prevent operation of the firearm. Biasing structure operatively engages the pin and is adapted to bias the pin out of the opening and out of engagement with the firing mechanism, and toward the engagement portion of the lock. An adjacent surface of the engagement portion is contoured such that when the engagement portion is in a first position, the pin is contacted by a first surface portion of the engagement portion to drive the pin into the firearm and into operative engagement with the firing mechanism. When the engagement portion is in a second position, the pin is contacted by a second surface portion of the adjacent surface, permitting the pin to extend outward under the influence of the biasing structure to a position out of engagement with the firing mechanism, thereby permitting operation of the firearm.

BRIEF DESCRIPTION OF THE DRAWINGS

There are shown in the drawings embodiments which are presently preferred, it being understood that the invention is not limited to the precise arrangements and instrumentalities shown, wherein.

DETAILED DESCRIPTION OF THE PREFERRED EMBODIMENTS

Figure 1:
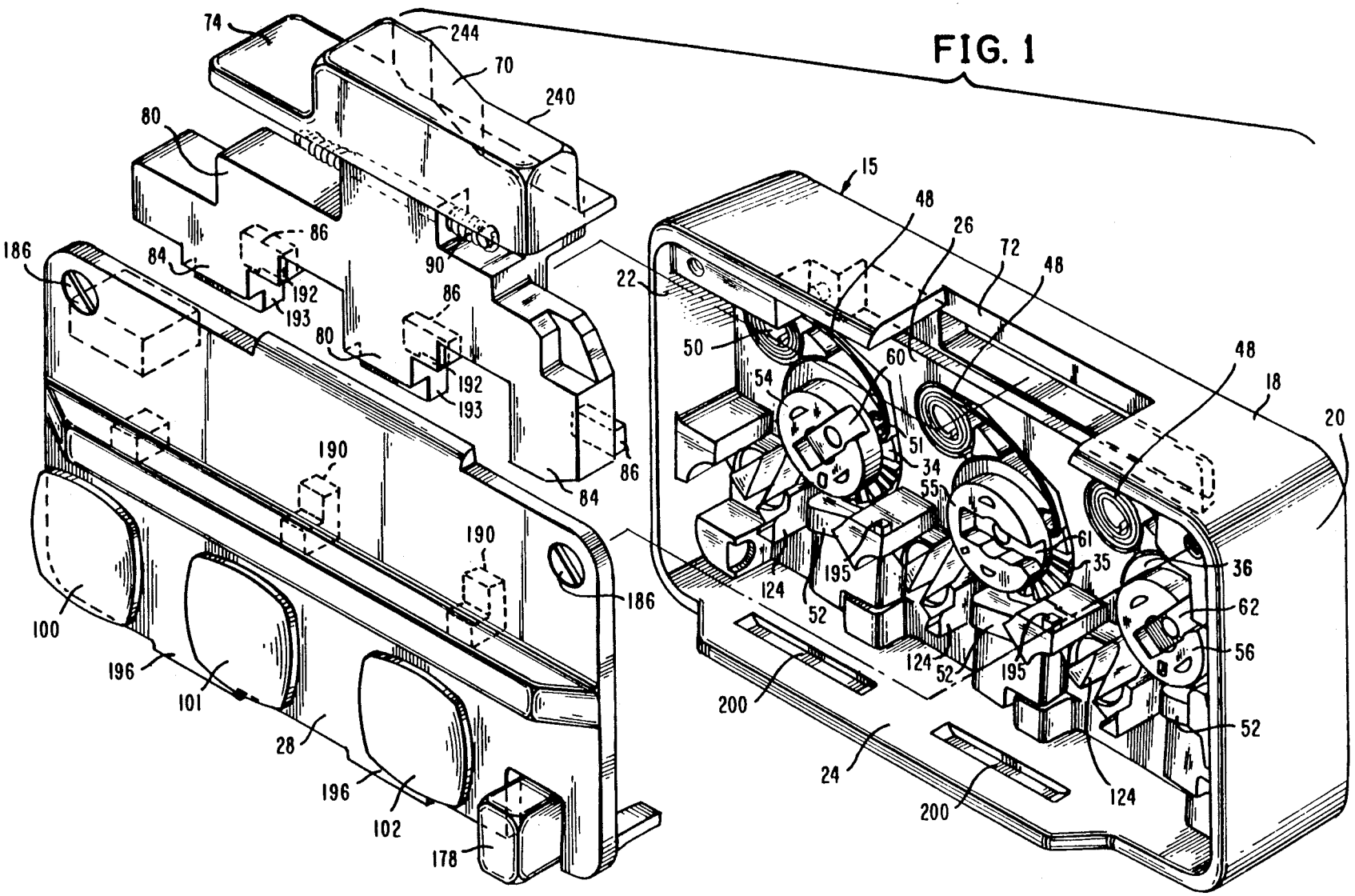
FIG. 1 is a exploded perspective of a firearm safety lock according to the invention.

The present invention describes modifications and improvements to the device set forth in Applicant's co-pending application Ser. No.202,988, filed June 6, 1988, and now U.S. Pat. No. 4,987,693. The disclosure of this application and patent is hereby fully incorporated by reference. The firearm safety mechanism of the invention can be used, with minor modification, in gun designs of many descriptions. The operation of most hand guns is well understood, and described in several volumes including the *Gun Digest Book of Firearms Assembly/Disassembly, Parts I and II, Automatic Pistols and Revolvers,* by J. B. Wood, D.B.I. Books, Inc., Northbrook, Ill., 1979; *The S&W Revolver,* A Shop Manual, by Jerry Kuhnhavsen, V.S.P. Publishers, Department 1A, Box 1966, Tusten, Calif. 92681; *The Colt 45 Automatic, A Shop Manual,* by Jerry Kuhnhavsen, V.S.P. Publishers, Department 1A, Box 1966, Tusten, Calif. 92681; and *The NRA Guide to Firearms Assembly,* National Rifle Association of America, 1600 Rhode Island Avenue, N.W., Washington, D.C., 20036. The disclosures of the above-identified references are hereby incorporated fully by reference.

The invention in connection with weapons such as the Beretta model 84BB, manufactured by the Fabbrica d'ArmiPietro Beretta S.P.A. of Via Pietro Beretta, 18-25063 Gardone Val Trompia, Brescia, Italy. The weapon is fully described in the Owner's Manual Beretta dal 1526 series, 81 which manual is hereby fully incorporated by reference. Aspects of the invention are also suitable for use with revolvers, such as that manufactured by the Smith & Wesson Company of 2100 Roosevelt Avenue, Springfield, Mass. and described in the Safety and Instruction Manual, Revolvers, 1987, which is distributed by the company. The disclosure of this reference is also hereby incorporated fully by reference.

The firearm safety lock of the invention includes a housing 15 which is adapted for mounting to a hand gun in the manner described in Applicant's co-pending U.S. patent application Ser. No. 202,988, filed June 6, 1988, now U.S. Pat. No. 4,987,693, the disclosure of which is incorporated fully by reference. The lock housing 15 in this embodiment includes a top plate 18, side plates 20, 22, a bottom plate 24, a back plate 26, and a removable face plate 28. At least one ratchet wheel is rotatably mounted within the housing, and preferably there are three ratchet wheels 34–36. The ratchet wheels 34–36 are rotatably joined to the back face 26 by suitable axles 38, and can be rotatably jointed to the axles 38 by suitable bearing structure. The ratchet wheels 34–36 can be substantially disk-like, having a diameter in excess of the thickness of each ratchet wheel, to minimize the width of the lock. Each of the ratchet wheels has a plurality of ratchet teeth 40. The ratchet teeth 40 preferably each have ramp portion 44. A ratchet return spring 48 is associated with each of the ratchet wheels 34–36 and is adapted to bias the ratchet wheels for rotation about the axles 38. An end 50 of the ratchet return springs 48 can be fixed to the back plate 26 of the housing 15, and an opposite end 51 of the ratchet return spring 48 can be fixed to the ratchet wheels 34–36. The ratchet wheels can be retained on the axles 38 by suitable means, in which can include a simple press-fit. The ratchet wheels 34–36 shown in the present embodiment are biased to rotate in a counter-clockwise direction.

A ratchet pawl 52 is associated with each ratchet wheel and is adapted to engage the ratchet teeth 40 to prevent rotation of the ratchet wheels 34–36, against the bias of the ratchet return springs 48. The ratchet pawls 52 are pivotally mounted at an end 67 about a pinion 69 so as to permit pivoting of an engagement portion 53 of the pawl 52 out of engagement with the ratchet teeth 40. A spring such as the leaf spring 58 can be associated with each pawl 52 and is adapted to bias the engagement portion 53 of the pawl into engagement with the ratchet teeth 40.

Each ratchet wheel 34–36 has associated therewith a lock disk 54–56, respectively and can have suitable keys 57 to engage any one of several different angularly disposed key way openings 59 to secure the locking disk in a radial position relative to the ratchet wheel. Each lock disk 54–56 has a locking channel 60–62, respectively. Each locking channel 60–62 can be formed in the face of the lock disks 54–56, which channels preferably open away from the back plate 26 and to at least one side of each lock disk 54–56.

An engagement portion 70 is slidably mounted through an aperture 72 in the top plate 18. The engagement portion 70 is adapted to cooperate with a portion of an external safety mechanism of the firearm to prevent operation on the firearm. In first position of the engagement portion 70, the engagement portion 70 blocks the path of the external safety mechanism and prevents the external safety from movement from a "safe" position to an "unsafe" position. In a second position the engagement portion 70 is moved out of the path of the external safety mechanism, such that movement of the external safety mechanism to the "unsafe" position is permitted. This operation was described fully in Applicant's parent application Ser. No. 202,988, filed June 8, 1988. In another embodiment to be described, the engagement portion 70 works in tandem with additional locking structure. A flange 74 can be provided on the engagement portion 70 to block unauthorized access to the lock through the opening 74.

Figure 2:
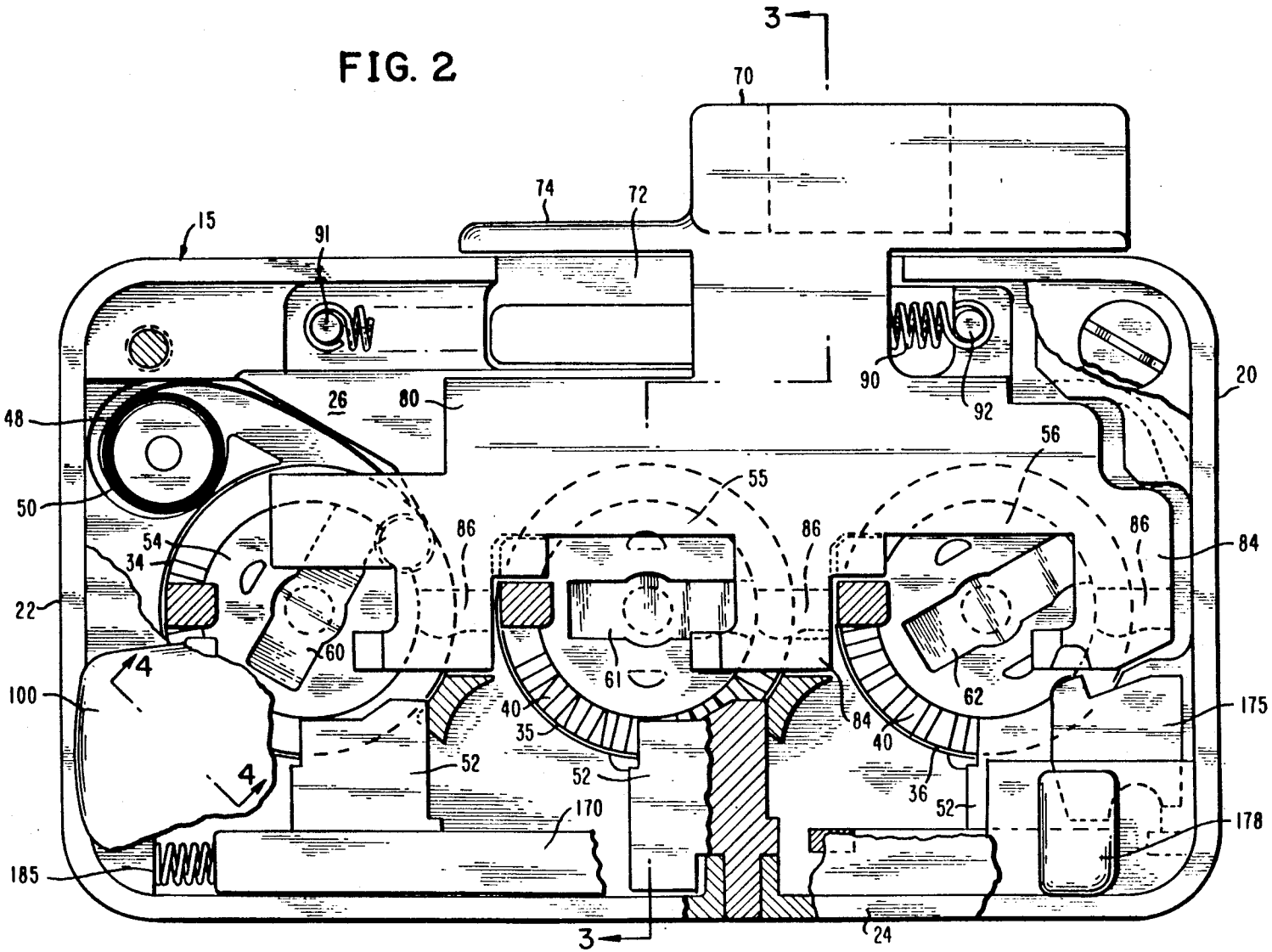
FIG. 2 is a front elevation, partially broken away and partially in phantom.
Figure 3:
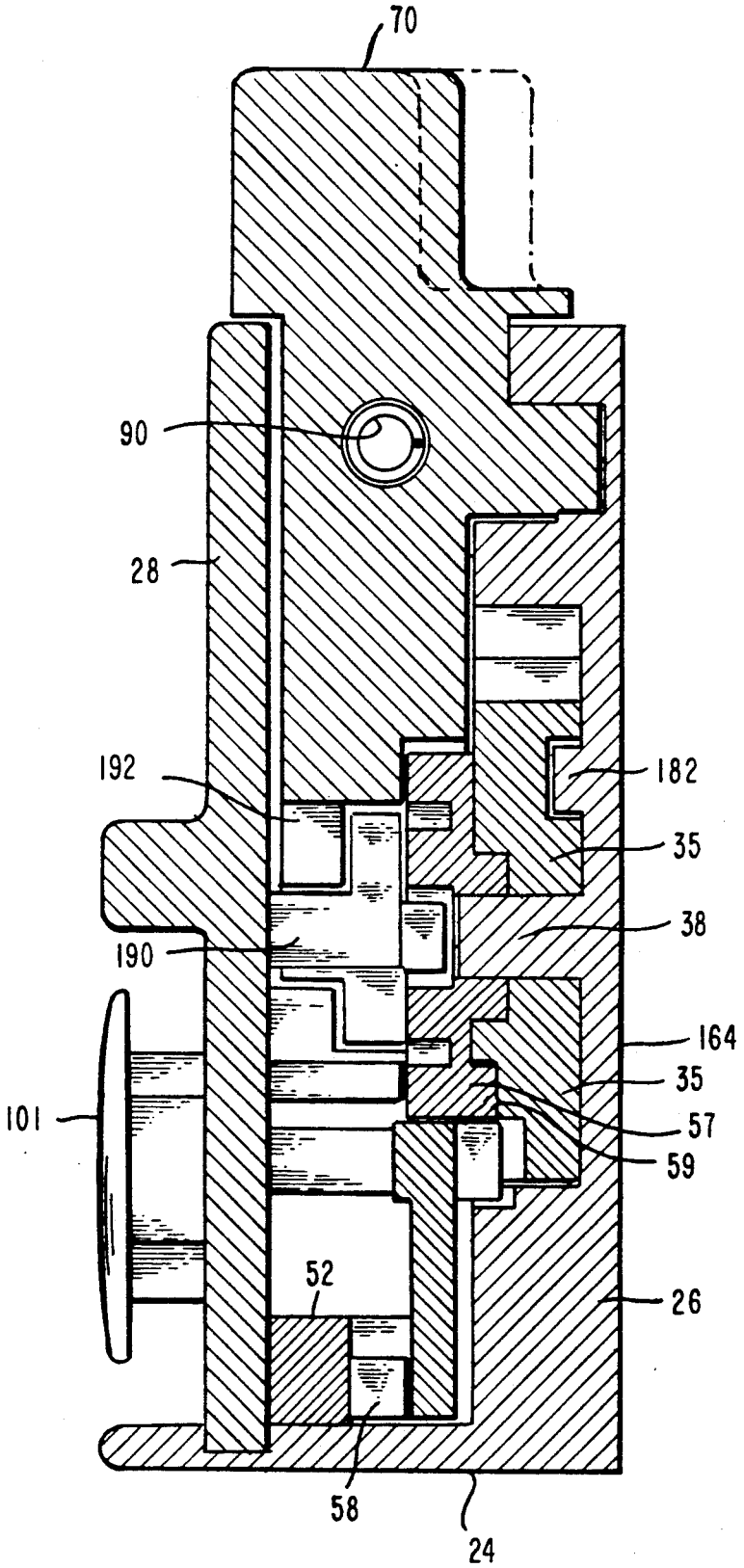
FIG. 3 is a cross-section taken along line 3—3 in FIG. 2.
Figure 4:
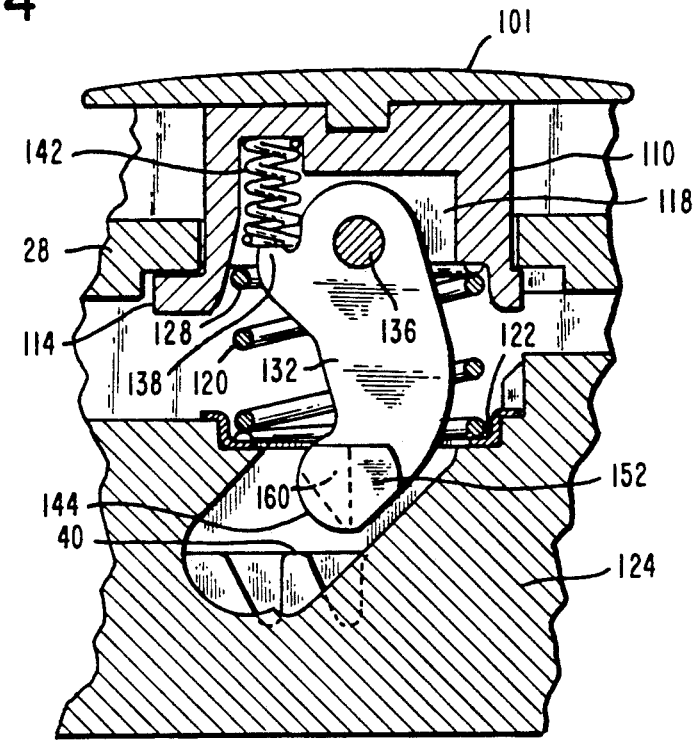
FIG. 4 is a cross-section taken along line 4—4 in FIG. 2, and in a first mode of operation.
Figure 5:
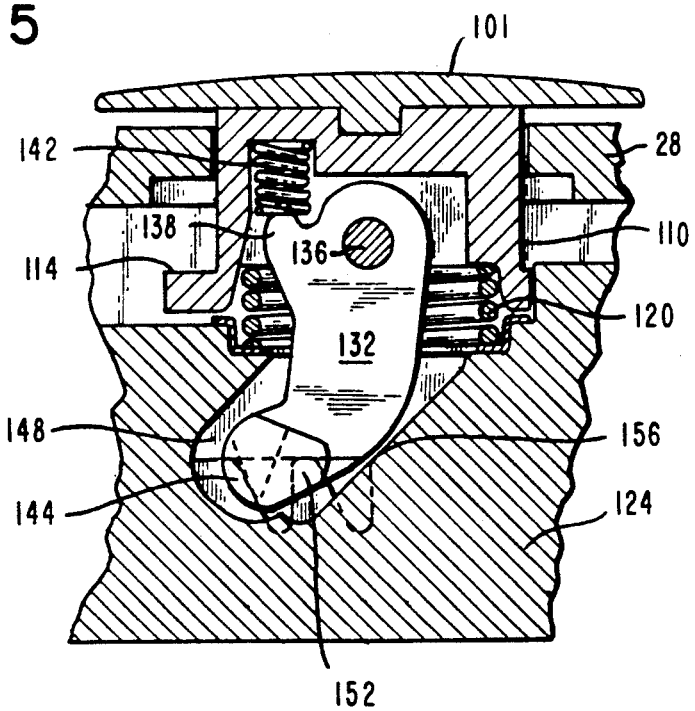
FIG. 5 is a cross-section taken along line 4—4 in FIG. 2, and in a second mode of operation.
Figure 6:
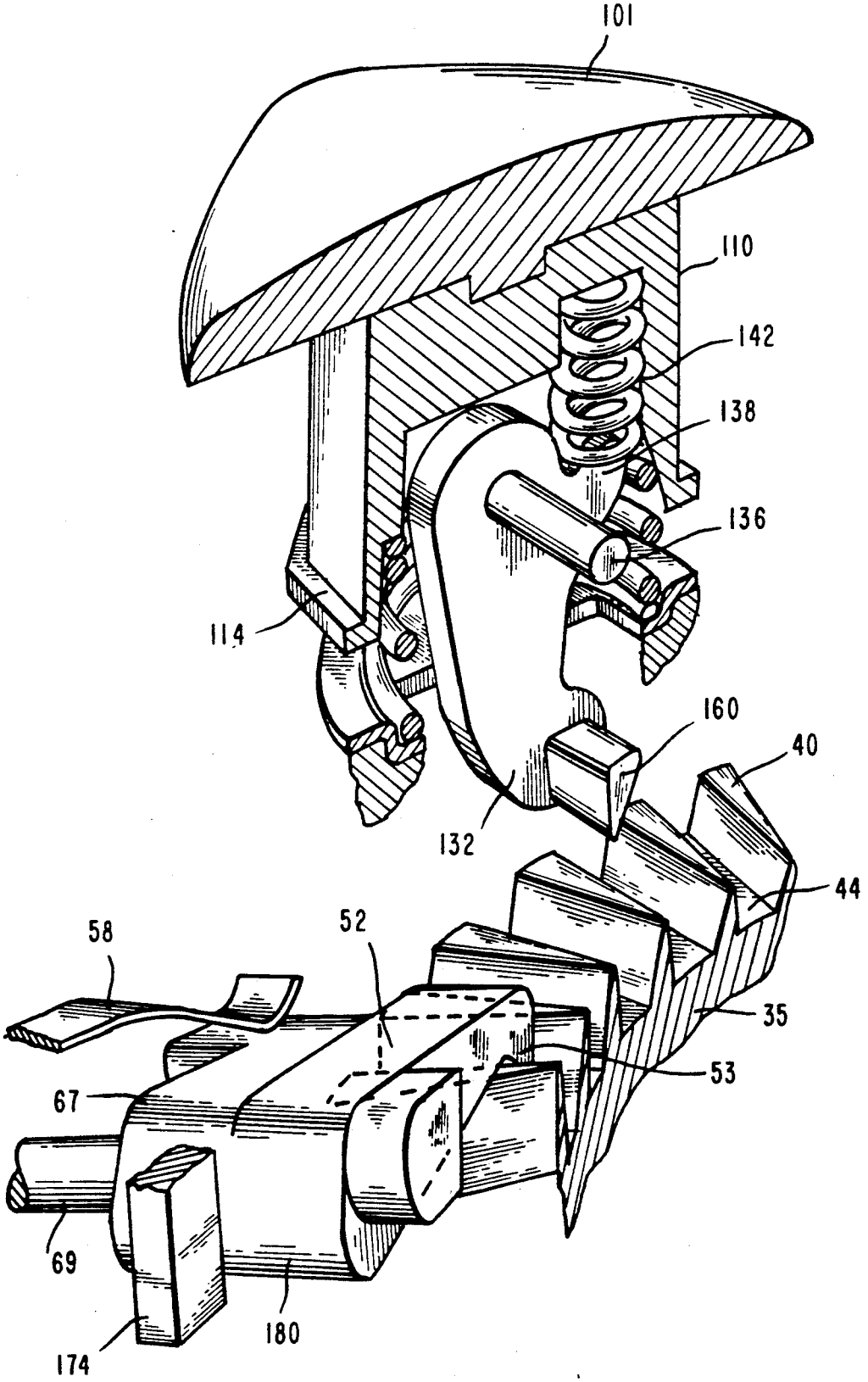
FIG. 6 is a perspective view, partially broken away and partially in phantom of a ratchet actuator assembly according to the invention, and in a first mode of operation.
Figure 7:
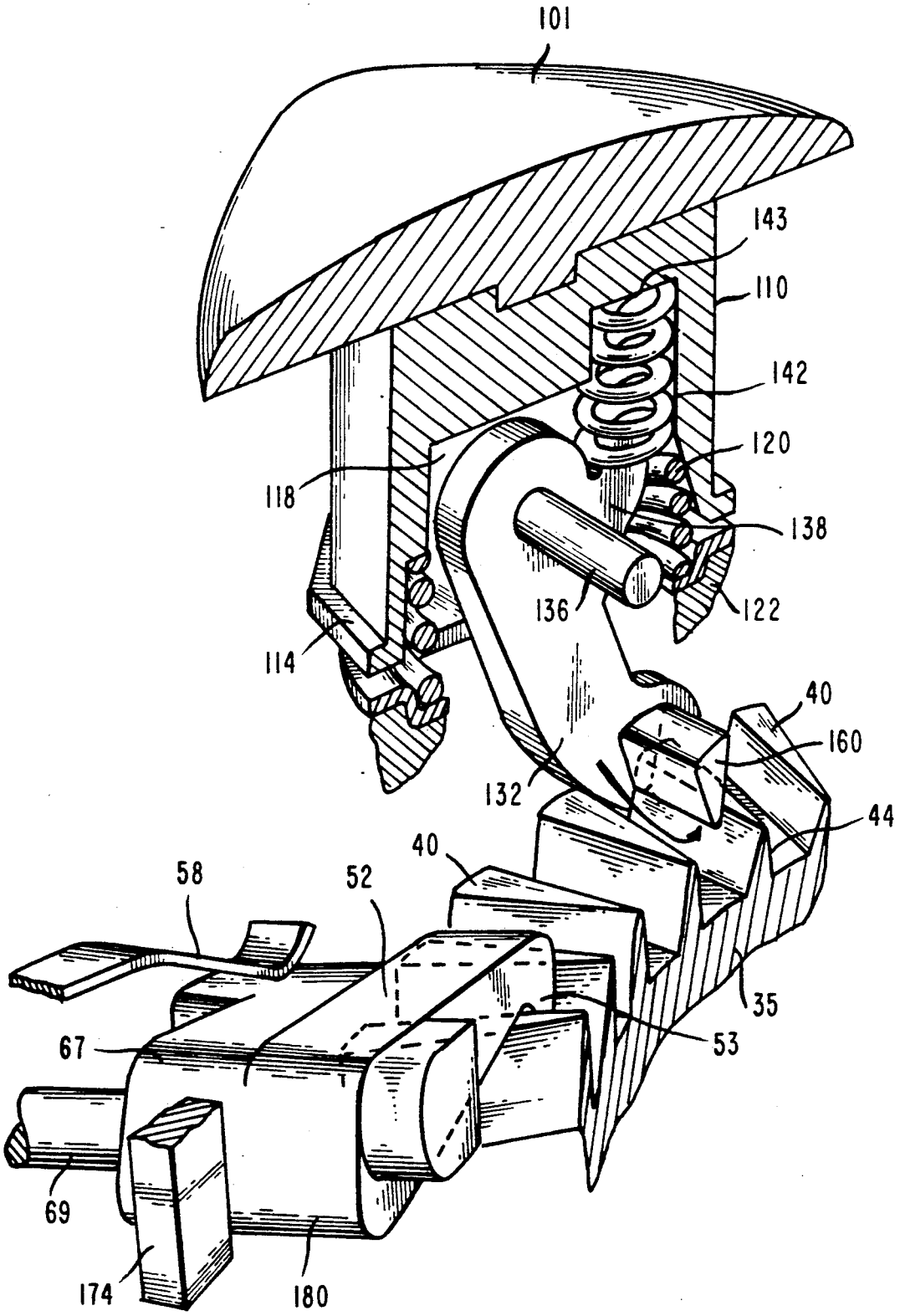
FIG. 7 is a perspective view similar to FIG. 6 and in a second mode of operation.
Figure 8:
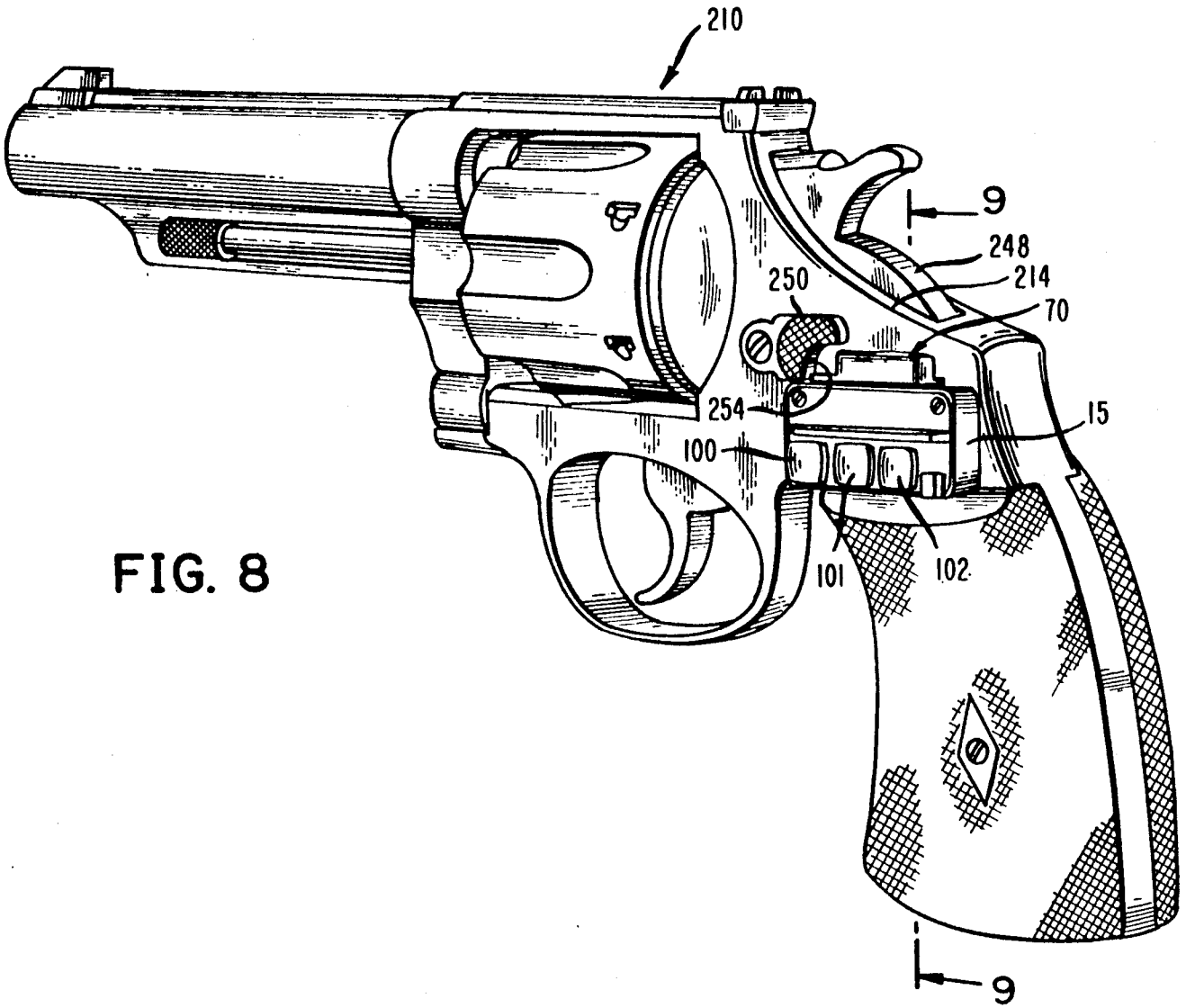
FIG. 8 is a perspective view of a revolver including an embodiment of the invention.

A lock slide 80 is operatively engaged, and preferably directly fixed, to the engagement portion 70. The lock slide 80 preferably has depending fingers 84 adjacent each of the lock disks 54–56. Each protrusion 86 extends in the direction of the lock disks 54–56 and are dimensioned so as to fit into the lock channels 60–62. When the ratchet wheels 34–36 are rotated the proper number of times, the locking channel 60–62 of the locked disks 54–56 align with the protrusions 86 to permit the lock slide 80 to move to the left in FIG. 2. This will permit the engagement portion 70 to move to the left and out of operative engagement with the external safety of the weapon, such that the safety can be moved to the "unsafe" position and the weapon fired. A spring 90 can be provided and fixed to a suitable pin 91 on the back plate 26 and to a second pin 92 on the lock slide 80. In that manner, the spring 90 will act to move the lock slide 80 out of operative engagement with the external safety mechanism whenever the lock disks 54–56 are aligned with the protrusions 86 by proper manipulation of the lock, to provided automatic disengagement of the engagement portion and quick operation of the weapon.

The manipulation of the ratchet wheels 34–36 is accompanied by pushbuttons 100–102 which cooperate with the ratchet wheels 34–36. A shaft 110 is provided for each of the pushbuttons 100–102. The shaft 110 is mounted through suitable apertures provided in the face plate 28. A flange 114 is positioned inside the face plate 28 and is dimensioned so as to prevent removal of the shaft 110 from the respective apertures in the face plate 28. Each shaft 110 has an open interior 118 within which is mounted a spring 120 which operates between suitable spring seats 122 on a pedestal 124, and on an interior surface 128 of the shaft 110. Each pedestal 124 is preferably fixed to the back plate 26. A ratchet actuator 132 is preferably pivotably mounted within the open interior 118, as about pinion 136. The ratchet actuator 132 has at one end thereof a spring arm 138, to which a spring 142 is mounted. The spring 142 bears against a surface 143 in the interior 118 of the shaft 110. An end 144 of the ratchet actuator 132 distal to the pinion 136 extends into a suitable opening 148 provided in the pedestal 124. A surface 152 of the ratchet actuator 132 is adapted for sliding movement against a surface 156 with the opening 148. A ratchet actuator finger 160 can extend outward from a side surface of the end 144 of the ratchet actuator 132 so as to be positioned substantially above the ratchet teeth 40 of the ratchet wheels 34–36.

Upon depression of the buttons 100–102, the ratchet actuator 132 associated with each button will likewise be depressed. The surface 152 of each ratchet actuator 132 will slide along the surface 156. The surface 156 is contoured to impart a downward and sideways movement to the ratchet finger 160. The ratchet finger 160 will thereby be driven into engagement with the ratchet teeth 40, which will rotate the respective ratchet wheel a sufficient distant so as to advance the ratchet wheel past the pawl 52. The pawl 52 will rise on contact with the slanted surface 44 of the succeeding ratchet tooth 40, and thereafter fall behind the tooth to prevent the ratchet wheel from returning under the action of the ratchet return spring 48. The spring 58 biases the pawl 52 into engagement with the succeeding ratchet tooth 40. In this manner, each depression of one of the buttons 100–102 will advance the associated ratchet wheel a given distance.

Upon release of the button 100–102, the spring 120 will act to withdraw the ratchet actuator 132 and the ratchet finger 160 from engagement with the ratchet teeth 40. The spring 142 pivots the ratchet actuator 132 about the pinion 136 to return the actuator 132 to its original position. Movement of each ratchet wheel 34–36 will move the associated lock disk 54–56 a corresponding angular distance. This will act to bring the locking channel 60–62 into alignment with the protrusions 86 on the lock slide 80.

The number of pushes required to align each locking channel with the respective protrusion 86, which is equivalent to the combination, can be changed by altering the orientation of each lock disk 54–56 relative to the respective ratchet wheel 34–36. This can be accomplished by removing the lock disk 54–56 from the respective ratchet wheel, and rotating the lock disk relative to the respective ratchet wheel. The new orientation will accordingly require a different number of pushes on the associated button to properly align the lock channel with the protrusions 86. The keys 53 of the lock disks are engaged to the desired key openings in the ratchet wheels 34–36 to retain the desired angular alignment between the lock disks 54–56 and the ratchet wheels 34–36.

Resetting of the lock is accomplished by a lock slide 170 having engaged thereto a reset abutment member 174 associated with each ratchet pawl 52. A reset button 178 is fixed to the reset slide 170 and extends through a suitable opening in the face plate 28. Sliding movement of the reset button 178 will move the reset slide 170 and corresponding reset abutment members 174 into the pawls 52. Each pawl 52 at the end 54 has a contact surface 180 which slopes toward the reset abutment member 174 and downward toward respective ratchet wheel. Movement of the reset abutment member 174 against this surface will cause the ratchet pawls 5 to pivot upward and out of engagement with the ratchet teeth 40. This will permit the ratchet wheels 34–36 to rotate under the influence of the ratchet reset springs 48. A lift 175 will pivot with movement of the reset slide to engage a back face of the lock slide 80 and move it away from the ratchet wheels 34–36. A detent 182 on the back plate 26 is adapted to engage a cooperating stop surface on each ratchet wheel to stop the ratchet wheel at an initial radial starting position. In this manner, the same number of depressions will always be necessary to properly align the lock channels 60–62 with the protrusions 84. Return of the reset slide 170 following the reset procedure can be accomplished by the provision of a suitable spring 185.

The face plate 28 ca be secured to the housing 15 by suitable structure such as screws 186. Additional structure can be provided to prevent the removal of the face plate 28. Substantially L-shaped engagement members 190 can be provided on an interior surface of the face plate 28 and are positioned and dimensioned such that the leg portions 192 of the fingers 84 of the lock slide 80 will be positioned substantially between the engagement members 190 and the face plate 28 when the lock slide 80 is in the locked position. Depending surfaces 193 of the fingers 84 will be positioned between members 195 and the back plate 26. The members 195 are fixed to the back plate 26 such that the lock slide 80 will be positioned and locked to the face plate 28 and back plate 26 when the lock slide 80 is in the locked position. When the correct combination is entered, the lock slide 80 moves relative to the face plate 28 to disengage the flanges 192 from the engagement members 190. In this manner, the face plate 28 can be removed only when the lock is unlocked. The face plate 28 additionally can be provided with depending flanges 196 which are adapted to fit suitable depressions 200 in the base plate 24.

The lock of the invention is not bulky, and can be readily attached to an external surface of a firearm adjacent an external safety mechanism of the firearm, to position the engagement portion substantially adjacent the external safety mechanism, whereby the engagement portion 70 will cooperate with the external safety mechanism of the weapon to enable the operator to lock the external safety mechanism in the "safe" position, and to thereby prevent unauthorized operation of the firearm. The buttons 100–102 can be conveniently located in the lock of the invention at a side position that is readily manipulated by the thumb of the operator. This would permit quick unlocking and operation of the weapon in an emergency. The invention can be utilized with the engagement portion 70 provided in a variety of different configurations depending on the firearm at hand. Revolvers such as the revolver 210 typically do not have an external safety mechanism. The invention can be utilized with this type of firearm with additional modifications. The lock housing 15 is mounted to an exterior frame surface 214 of the firearm and an aperture is drilled through the frame. A fitting 216 is preferably fitted into the aperture, which fitting has a central opening fitted. A pin 218 positioned in the opening and is slidable through the opening. A flange 222 at an interior end of the pin 218 is adapted to abut a lip 224 of the fitting 216 to prevent passage of the pin 218 through the fitting 216. An engagement head 230 is provided in an exterior end of the pin 218, and has formed therein a seat 232 for a spring 236.

Figure 9:
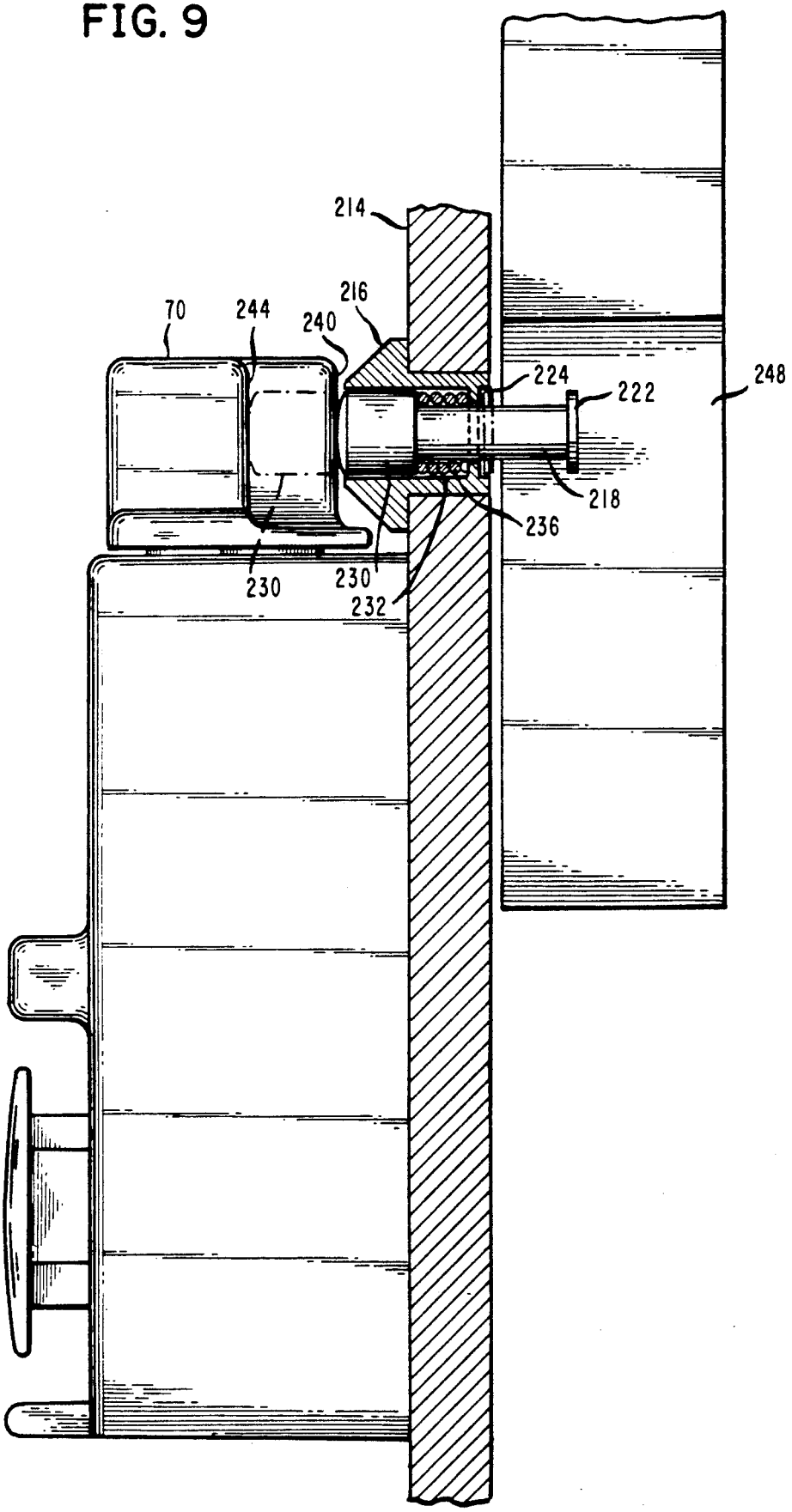
FIG. 9 is a cross-section taken along the line 9—9 in FIG. 8, and partially in phantom.

The spring 236 is adapted to bias the pin 218 out of the aperture of the fitting 216 and toward an adjacent surface of the engagement portion 70. The engagement portion 70 is provided with an adjacent contoured surface facing the head 230, which surface has an innermost portion 240 and an outermost portion 244 (FIG. 1). Positioning of the outermost portion 244 adjacent the head 230 will drive the pin 218 into the firearm (FIG. 9). The pin 218 is positioned such that, when the pin 218 is extended into the interior of the firearm, it will substantially block the path of the hammer 248 to prevent operation of the firearm. When the lock is correctly manipulated, the engagement portion 70 can be moved such that the innermost portion 240 of the engagement portion is placed adjacent to the head 230. The pin will then be driven by the spring 236 out of the firearm (phantom lines in FIG. 9) and out of the path of the hammer 248. The positioning of the barrel release leaver 250 on the revolver 210 may interfere with proper operation of the engagement portion 70, and accordingly, a portion 254 can be removed if necessary.

The invention can be useful as a lock, with modifications, and apart from a firearm. It is apparent that the invention is capable of many modifications without departing from the spirit or essential attributes of the invention, and accordingly, reference should be had to the following claims, rather to than the foregoing specification, as indicating the scope of the invention.

I claim:

1. A firearm safety lock, comprising:

an engagement portion moveable between a locked position in which the engagement portion operatively engages a moveable portion of the firing mechanism to prevent discharge of the firearm, and an unlocked position permitting operation of the firearm;

a moveable lock member operatively connected to the engagement portion and having at least one protrusion;

at least one rotatable ratchet wheel having a plurality of ratchet teeth and at least one channel adapted to receive said protrusion when said ratchet wheel is related to align said channel with said protrusion;

a push button adjacent to each ratchet wheel, said push button being adapted for movement substantially parallel to the axis of rotation of said ratchet wheel;

at least one ratchet actuator positioned substantially adjacent to said ratchet teeth of said ratchet wheel, substantially axial movement of said push button being adapted to move said ratchet actuator so as to rotate said ratchet wheel, whereby depression of said push button a predetermined number of times will rotate said ratchet wheel so as to align said channel with said protrusion, said alignment permitting insertion of said protrusion into said channel, and thereby movement of said engagement portion from said locked position to said unlocked position.

2. The firearm safety mechanism of claim 1, further comprising at least one spring operatively engaged to each of said push buttons and being adapted to retain said pushbuttons to an initial, raised position following the depression of said pushbutton, whereby a plurality of pushes of said of said pushbutton will cause sequential engagement of said ratchet teeth and rotation of said ratchet wheel.

3. The firearm safety mechanism of claim 1, wherein said channels are each provided in a lock disk, a lock disk being affixed to each ratchet wheel.

4. The firearm safety mechanism of claim 3, wherein the lock disks are moveable with respect to said ratchet wheels, whereby a relative position of the channel to the ratchet wheel can be changed to alter the number of depressions of the pushbuttons necessary to align the channel with the protrusions.

5. The firearm safety mechanism of claim 1, further comprising means for biasing said ratchet wheels for rotation abut an axis, and a pawl adapted to engage said ratchet teeth to prevent rotation of said ratchet wheels under the influence of said biasing means.

6. The firearm safety mechanism of claim 5, further comprising reset means, said reset means being adapted to move said pawls out of contact with said ratchet teeth, and a stop on said ratchet wheel and a stop surface fixed relative to said firearm, said stop on said ratchet wheel being adapted to engage the stop surface fixed to said firearm to halt rotation of said ratchet wheels at an predetermined starting position.

7. The firearm safety mechanism of claim 6, wherein said reset means comprises a reset slide member adapted to move each pawl from contact with the ratchet portions of the respective ratchet wheel, whereby movement of the reset slide will remove each pawl from the respective ratchet wheel and will thereby permit said ratchet wheels to rotate under the influence of said biasing means to said predetermined starting position.

8. The firearm safety mechanism of claim 1, further comprising spring means adapted to move said lock members and said protrusion into said channels when said protrusions are aligned with said channels.

9. The firearm safety mechanism of claim 1, wherein said ratchet actuator is provided substantially adjacent to a ratchet guide surface, said ratchet actuator having a ratchet finger adapted to engage said ratchet teeth of said ratchet wheel, downward movement of said ratchet actuator causing sliding contact with said guide surface and rotation of said ratchet actuator downward rotation of said ratchet actuator causing said ratchet finger to engage said ratchet teeth and to rotate said ratchet wheel.

10. The firearm safety mechanism of claim 9, wherein said lock member, said ratchet wheels and said ratchet actuators are positioned within an enclosed lock housing, said pushbuttons and said engagement portion extending through openings in said lock housing.

11. The firearm safety mechanism of claim 10, wherein said lock housing is fixed to an exterior surface of said firearm and said engagement portion comprises an abutment surface, said abutment surface of said engagement portion being positioned substantially adjacent to an external safety mechanism of said firearm, said external safety mechanism being moveable between a "safe" position preventing operation of the firearm and an "unsafe" position permitting operation of the firearm, said abutment surface being moved from said operative engagement when said lock member and said protrusions are moved into said channels, whereby operation of the firearm will be possible upon the depression of said pushbuttons, a predetermined number of times necessary to align said channels with said protrusions.

12. The firearm safety mechanism of claim 11, wherein said engagement portion engages a pin extending through a suitable opening in said firearm to a position substantially within said firearm, said pin being slidable through said opening to a position where said pin operatively engages a portion of the firing mechanism of said firearm so as to prevent operation of said firearm, biasing means operatively engaging said pin and being adapted to bias said pin out of said operation and out of engagement with said firing mechanism, and towards said interior surface of said pin enclosure, said interior surface being contoured such that when said pin enclosure is in a first position corresponding to said protrusions of said lock member being out of said channels, said pin is contacted by a first portion of said interior surface to drive said pin into said firearm and into operative engagement with said firing mechanism, and when said pin enclosure is in a second position corresponding to said protrusion being positioned in said channels, said pin is contacted by a second portion of said interior surface permitting said pinto extend outward under the influence of said biasing means to a positioned out of engagement with said firing mechanism to permit operation of said firearm.

* * * * *